US006050201A

United States Patent [19]

Blanchard et al.

[11] Patent Number: 6,050,201

[45] Date of Patent: Apr. 18, 2000

[54] SWIVELING AUTOMOTIVE KNEEBOARD

[76] Inventors: David K. Blanchard, 66 Northam Ct., Slidell, La. 70458; James W. Blanchard, Jr., 1 Bent Tree La., Hilton Head, S.C. 29926

[21] Appl. No.: 09/307,594

[22] Filed: May 10, 1999

[51] Int. Cl.[7] ..... A47B 23/00

[52] U.S. Cl. ..... 108/43

[58] Field of Search ..... 108/43, 44, 45, 108/94, 20, 21, 22; 248/444

[56] References Cited

U.S. PATENT DOCUMENTS

| | | | |
|---|---|---|---|
| D. 257,589 | 12/1980 | Shaffert . | |
| D. 315,456 | 3/1991 | Couch et al. . | |
| D. 353,275 | 12/1994 | Longhurst . | |
| D. 359,398 | 6/1995 | Jaykus . | |
| D. 360,318 | 7/1995 | Kinnard, Sr. et al. . | |
| 2,701,173 | 2/1955 | Senior et al. . | |
| 2,876,022 | 3/1959 | Kroviak | 108/43 |
| 3,215,453 | 11/1965 | Malcom, Jr. | 108/43 X |
| 3,232,685 | 2/1966 | Wilstein et al. . | |
| 3,730,077 | 5/1973 | Selden | 108/43 |
| 4,243,249 | 1/1981 | Goss . | |
| 4,903,932 | 2/1990 | Stewart, Jr. . | |
| 5,487,521 | 1/1996 | Callahan | 108/44 X |
| 5,520,119 | 5/1996 | Eisenberg | 108/43 |
| 5,615,817 | 4/1997 | Shevers, Jr. | 108/43 X |
| 5,687,422 | 11/1997 | Wurst et al. | 108/43 X |
| 5,862,933 | 1/1999 | Neville | 108/43 X |

FOREIGN PATENT DOCUMENTS

| | | |
|---|---|---|
| 1550899 | 8/1979 | United Kingdom . |

*Primary Examiner*—Jose V. Chen
*Attorney, Agent, or Firm*—Richard C. Litman

[57] ABSTRACT

The swiveling automotive kneeboard has a base, a writing plate, a memo pad clip, and an elastic strap with hook and loop fastening material. The base has a substantially flat, planar top surface and a concave bottom surface reinforced with ribs. The writing plate is flat and planar on both top and bottom surfaces. The writing plate is pivotally attached to the base so that the writing plate may swivel 360° in a plane parallel to the base. A memo pad clip is attached to the writing plate for holding a pad of memo paper. A hook which pivots 360° about an axis parallel to and concentric with its stem is pivotally attached to the end of the memo pad clip, the hook being used to store the kneeboard on the steering wheel when not in use. The strap is used to secure the kneeboard to the user's thigh. The base includes a hinge so that the width of the base may be adjusted to the size of the user's thigh. The kneeboard is made from a lightweight, thermoplastic material.

16 Claims, 5 Drawing Sheets

SWIVELING AUTOMOTIVE KNEEBOARD

BACKGROUND OF THE INVENTION

1. Field of the Invention

The present invention relates to devices for attaching a clipboard or writing tablet to the leg of an operator or passenger of a vehicle, airplane, or other mode of conveyance, and particularly to an automotive kneeboard which swivels so that the operator may rotate a writing pad to a convenient angle.

2. Description of the Related Art

While some people have exceptional memories, most people find it helpful to jot down memoranda summarizing detailed information, such as phone numbers, directions, license numbers, time logs, and the like. A problem can arise when the need to make a memo arises when there is no firm writing surface available upon which a writing tablet may be supported. Airplane pilots may need to take notes of navigational, meteorological or other data for their flight log. Cockpit space may be limited, and in some cases a convenient writing surface may not be available and accessible to the pilot while seated at his controls.

Similar problems may affect the operator or passenger of a motor vehicle. Police officers, fire and rescue personnel, security officers, and the like may find it desirable to have a portable clipboard or memo pad available to write down addresses, license numbers, directions, phone numbers, descriptions, and similar information obtained either visually or by radio communications without the necessity of pulling over to write down the information. Commercial truck drivers may need to maintain time or mileage information for their logs. With the proliferation of cellular phones for mobile communications, many individuals people conduct business calls with their offices and with customers while driving.

Even when not mobile, a portable memo pad may be handy. Reporters, reviewers, and students may attend lectures, conferences, movies, or theaters where it would be helpful to take notes, but where facilities for supporting a writing pad are limited or absent.

Various devices have been developed to remedy this problem. U.S. Design Pat. No. 257,589, issued Dec. 2, 1980 to R. W. Shaffert, shows a steering wheel desk which has a flat plate with a clip on its top edge, the thickness of the plate sloping towards thin from top to bottom, and having a circular recess on its bottom surface which appears adapted for circumferentially resting the plate about a steering wheel. U.S. Design Pat. No. 315,456, issued Mar. 19, 1991 to Couch, et al., shows a lap desk which looks like a plate with a top hinged to the bottom along its top edge for storage of pads, pencils, etc.

U.S. Design Pat. No. 353,275, issued Dec. 13, 1994 to F. J. Longhurst, shows an automobile desk with a pair of flat plates having a clip at the top and an elongated swivel shaft or pivot pin at the bottom center of the two plates. U.S. Design Pat. No. 359,398, issued Jun. 20, 1995 to G. M. Jaykus, a table for use in a motor vehicle which appears to have a pair of side plates pivotally attached to a top plate which is hinged to a bottom plate along an edge, so that the unit may be folded for compact storage.

U.S. Design Pat. No. 360,318, issued Jul. 18, 1995 to Kinnard, Sr., et al., shows a steering wheel desk with front and rear plates hinged together having a projection to one side of the rear plate supporting a lamp mounted on a rod, and two pins at the back of the rear plate which pivot to lock the table to the steering wheel. U.S. Pat. No. 2,701,173, issued Feb. 1, 1955 to Senior, et al., teaches a board for pilots having a spring clip at the top and a saddle riveted to the bottom side, and includes an elastic band fixedly attached to one side of the saddle and releasably attached to the other side of the saddle for strapping the board to the pilot's leg, the length of the band being adjusted by a buckle.

U.S. Pat. No. 3,232,685, issued Feb. 1, 1966 to Wilstein, et al., describes a pilot's knee board with a top half and a bottom half attached by a screw, the top half having a clip. The bottom half is attached to a plastic panel which is strapped to the pilot's leg, the bottom half being attached to the plastic panel by a single bevel head screw so the board can rotate. U.S. Pat. No. 4,243,249, issued Jan. 6, 1981 to H. C. Goss, discloses a document holder assembly having a carrier plate with a first clip along a top edge and a second clip along a side edge, a base plate with a concave undersurface to fit around the thigh, and a strap which is fastened by "pile fabric" and a "pad of plastic hooks". The carrier plate swivels on the base plate, being connected either by a screw or by a stud.

U.S. Pat. No. 4,903,932, issued Feb. 27, 1990 to I. Stewart, Jr., describes a tablet holder secured to the thigh of a user by a strap with a Velcro® fastener. The tablet has a pivoting mechanism attaching the tablet to the strap which includes cylindrical upper and lower sleeves, the upper sleeve having either ribs or pins which engage either grooves or indentations in the lower sleeve to lock the tablet after rotation, the sleeves having a central pivot pin connected to a hub. U.K. Patent No. 1,550,899, published Aug. 22, 1979, describes a shelf for mounting to a steering wheel for eating when the vehicle is stationary, the shelf being attached to a mounting plate having a pair of hooks which hook onto the steering wheel above its diameter so that the mounting plate hangs from the steering wheel.

None of the above inventions and patents, taken either singularly or in combination, is seen to describe the instant invention as claimed, i.e., a kneeboard made from lightweight plastic with a writing pad which swivels 360°, a pivotally mounted hook for storage on the steering wheel, and a base having a "living hinge" to adjust the width of the pad base to accommodate different size thighs. Thus a swiveling automotive kneeboard solving the aforementioned problems is desired.

SUMMARY OF THE INVENTION

The swiveling automotive kneeboard has a base, a writing plate, a memo pad clip, and an elastic strap with hook and loop fastening material. The base has a substantially flat, planar top surface and a concave bottom surface reinforced with ribs. The writing plate is flat and planar on both top and bottom surfaces. The writing plate is pivotally attached to the base so that the writing plate may swivel 360° in a plane parallel to the base. A memo pad clip is attached to the writing plate for holding a pad of memo paper. A hook which pivots 360° about an axis parallel to and concentric with its stem is pivotally attached to the end of the memo pad clip, the hook being used to store the kneeboard on the steering wheel when not in use. The strap is used to secure the kneeboard to the user's thigh. The base includes a hinge so that the width of the base may be adjusted to the size of the user's thigh. The kneeboard is made from a lightweight, thermoplastic material.

Accordingly, it is a principal object of the invention to provide a kneeboard which has a firm surface for supporting a writing pad and which may be strapped to the user's leg for convenient access when operating a motor vehicle or other means of transportation.

It is another object of the invention to provide a kneeboard with a writing plate which pivots 360° in a plane parallel to a base so that a memo pad can be oriented in any desired direction.

It is a further object of the invention to provide a kneeboard with a hook adapted for storing the kneeboard on the steering wheel of a motor vehicle when not in use.

Still another object of the invention is to provide a swiveling automotive kneeboard with a concave base and an elastic strap for attachment to the user's thigh in which the width of the base may be adjusted to the size of the user's thigh.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
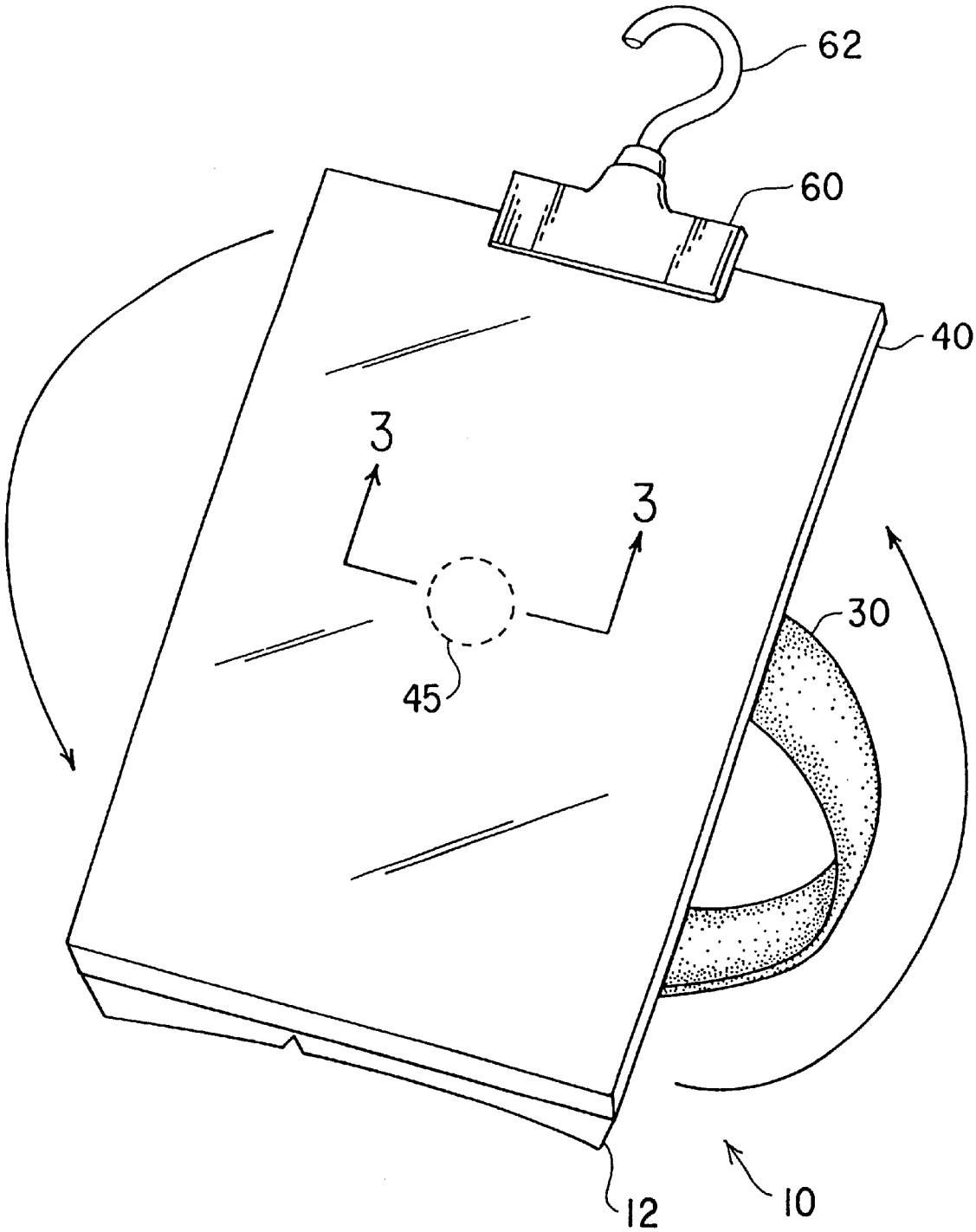
FIG. 1 is a perspective view of a swiveling automotive kneeboard according to the present invention.

The present invention is a swiveling automotive kneeboard, designated generally as 10 in the drawings. As shown in FIG. 1, the kneeboard 10 includes a base 12, a strap 30 for attaching the kneeboard to the user's thigh, a writing plate 40, and a conventional spring biased clip 60 for attaching a writing tablet or memo pad to the writing plate 40.

Figure 2:
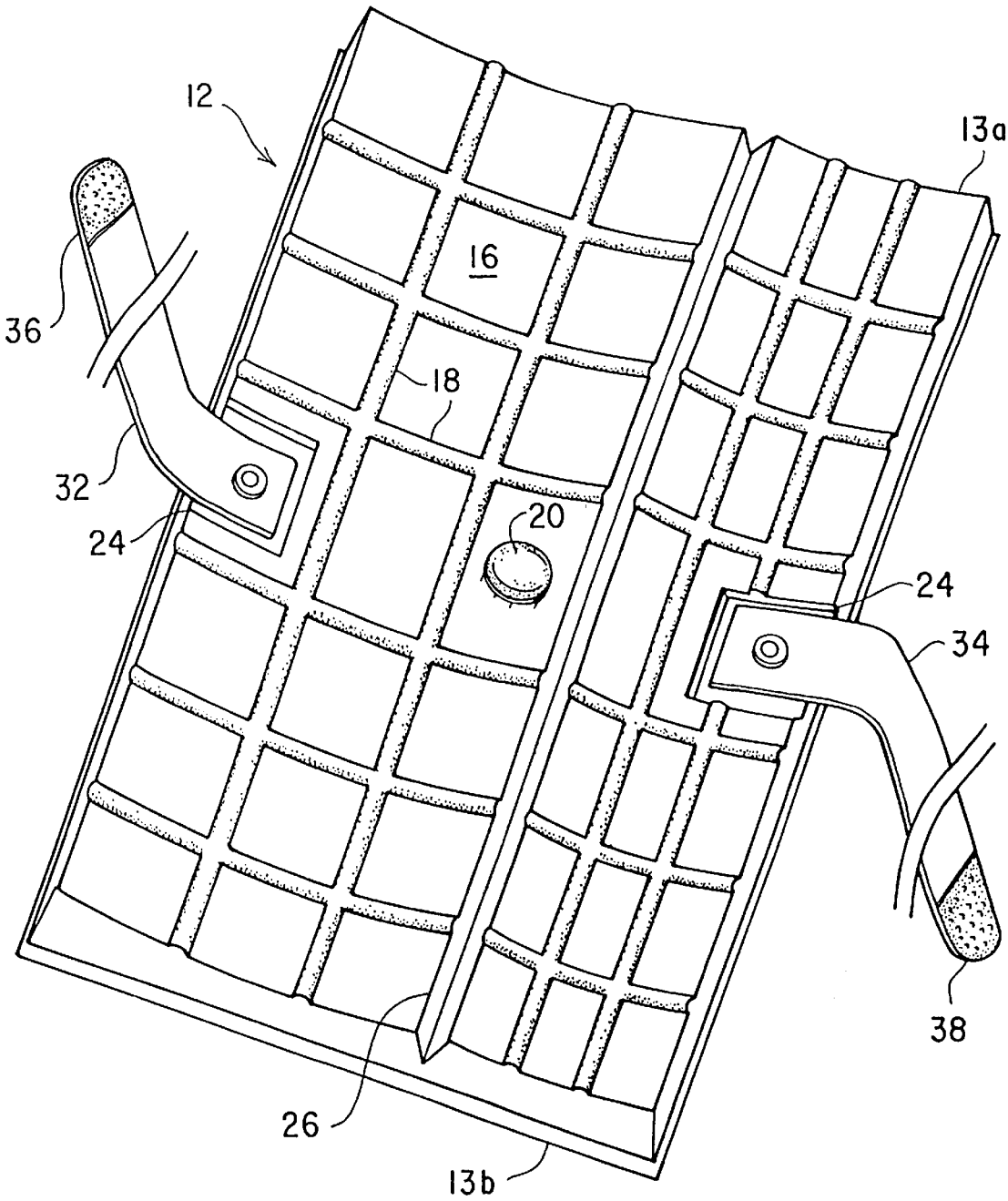
FIG. 2 is a bottom perspective view of the base of a swiveling automotive kneeboard according to the present invention.
Figure 3:
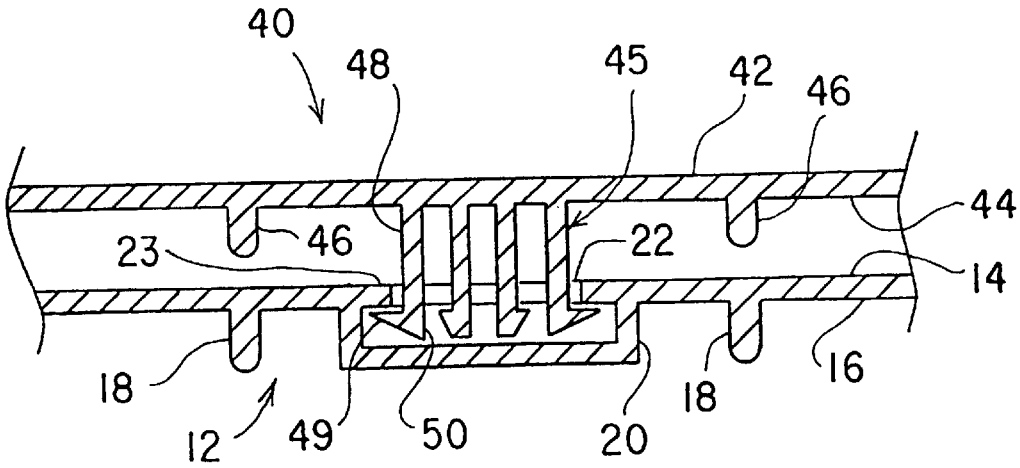
FIG. 3 is a section view along the line 3—3 of FIG. 1.

As shown in FIGS. 1, 2, and 3, the base 12 is a substantially rectangular body having a flat top surface 14 and a concave bottom surface 16, the bottom surface 16 being arched and contoured to fit comfortably on the top of the user's thigh. The base 12 is preferably made of an appropriate thermoplastic material formed by injection molding. The bottom surface 16 of the base 12 has a plurality of ribs 18 running both longitudinally and laterally molded integrally on the bottom surface 16. The ribs 18 serve to reinforce the base 12, permitting the rectangular top surface 14 to be made thinner, saving costs and permitting lightweight construction.

The base 12 has an integral, cylindrical socket 20 with a circular opening 22 on the top surface 14 which forms part of the mechanism for swiveling the writing plate 40. The diameter of the opening 22 is smaller than the diameter of the socket 20, forming a rim 23 or lip at the opening 22 projecting into the socket 20. The base 12 may have a pair of recesses 24 on opposing sides of the bottom surface 16 in which the strap 30 may be mounted. The base 12 also includes a so-called "living hinge" 26 extending longitudinally from one end 13*a* of the base 12 to the other end 13*b*. For purposes of this application, the term "living hinge" refers to an integral, relatively rigid body having a score line or thin, flexible linear region separating two thicker areas of the body and acting like a hinge so that the body may be bent or folded. The living hinge 26 provides a means for adjusting the width of the base 12 according to the size of the user's thigh, the base 12 remaining substantially planar when the thigh is broad, the hinge 26 bending up to 90° to conform the base 12 to a smaller thigh. In a preferred embodiment, the base 12 measures six inches long by four inches wide.

As shown in FIG. 2, the strap 30 has a first piece 32 and a second piece 34. The first piece 32 has an end fastened to one side of the base 12 and a second end having a fastener 36, preferably hook and loop fastening material, such as Velcro®. The second piece 34 has an end fastened to the opposite side of the base 12, and a second end having a fastener 38 adapted for releasably engaging the fastener 36 on the first piece 32. Preferably, at least a portion of each piece 32, 34 of the strap 30 is made from elastic, enabling the strap 30 to elongate in order to encircle the thigh.

The writing plate 40 is rectangular and shape and has a substantially flat top surface 42 and bottom surface 44. As shown in FIG. 3, the bottom surface 44 has a plurality of reinforcing ribs 46, the ribs 46 extending longitudinally and laterally in a pattern similar to the pattern of ribs 18 on the bottom surface 16 of the base 12 as shown in FIG. 2. The bottom surface 44 also includes a male connector 45 of a swiveling mechanism depending from the center of the bottom surface 44, comprising a plurality of half-arrow legs 48 arranged in a circular pattern, the diameter of the circle being substantially equal to the diameter of the circular opening 22 defined in the top surface of the base 12. The free ends of the legs 48 are shaped substantially like half of an arrowhead, having a flange 49 extending radially outward from the circle defined by the legs 48, the flange 49 sloping radially inward to the pointed tip end 50 of the leg 48. During assembly of the kneeboard 10, the writing plate 40 is pushed against the base 12, the male connector 45 of the swiveling mechanism being aligned with the socket 20, so that the sloping tip ends 50 of the legs 46 engage the rim of the opening 22, causing the legs 48 to flex inward until the flanges 49 enter the socket 20, passing the rim 23 so that the legs 48 resiliently snap back. Thus, the writing plate 40 is locked to the base 12 so that the writing plate 40 may rotate about the axis of the swiveling mechanism, but may not be pulled apart from the base 12, the flanges 49 extending under the rim 23. It will be understood that the specific form of swiveling mechanism shown in the drawings is for enabling purposes only, other conventionally known swivel mechanisms which permit 360° rotation of the writing plate 40 being appropriate for use with the present invention.

The writing plate 40 has substantially the same dimensions as the base 12, in a preferred embodiment being about eight and one-half inches long by five and one-quarter inches wide. The top surface 42 is flat and adapted for receiving a writing tablet or memo pad (not shown). A standard, convention spring-biased clip 60 is mounted at the top end of the writing plate 40 for securing a memo pad to the kneeboard 10. Such clips are well known in the prior art and the spring-bias mechanism of the clip 60 will not be described further.

Figure 4:
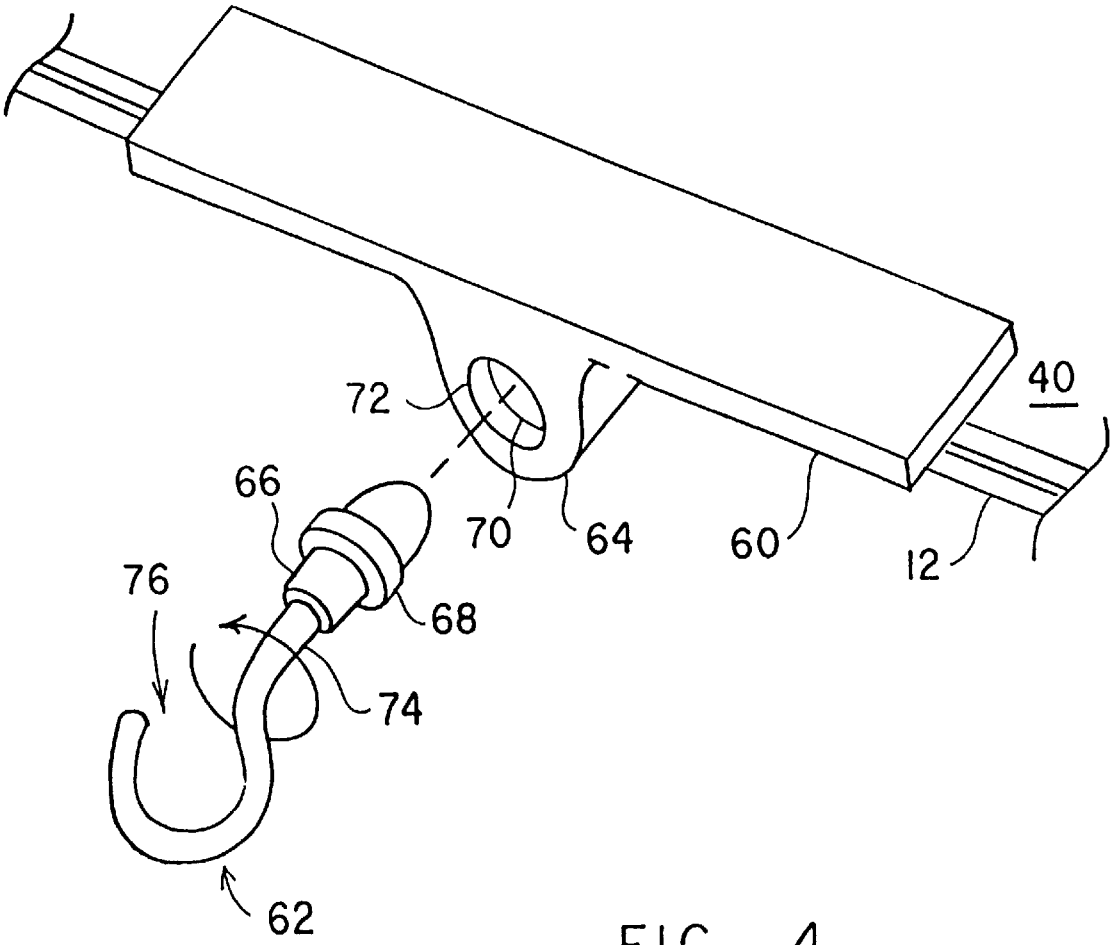
FIG. 4 is an partially exploded, fragmented, end perspective view of the clip of a swiveling automotive kneeboard according to the present invention.

The kneeboard 10 includes an optional hook 62 for storing the kneeboard 10 when not in use. The hook 62 is mounted in a socket 64 at the end of the thumb depressor portion of the clip 60, as shown in FIG. 4. The hook 62 has a male connector 66 with a flange 68 about its circumference which snaps into a hollow socket 64 having a lip 70 about its open end 72. The lip 70 retains the flanged connector 66 in the socket so that the hook 62 may be rotated 360° about its stem 74. The mouth 76 of the hook 62 has a width slightly greater than the diameter the edge of an automobile steering wheel so that the kneeboard 10 may be stored when not in use by hanging the hook 62 on the steering wheel of a vehicle. It will be understood that although the hook 62 is shown with a cylindrical body in the drawings, the body of the hook 62 may be flat. The hook 62 may be removed from the socket 64, if desired.

The writing plate 40, base 12, clip 60 and hook 62 are all preferably made from injection molded thermoplastic material for economy and light weight. The strap 30 is made from fabric, preferably including an elastic portion and having hook and loop fasteners.

In use, the swiveling automotive kneeboard 10 is strapped to the user's thigh, either left or right, so that the kneeboard 10 is positioned within comfortable reach when the user is seated, the elastic portion of the strap 30 and the living hinge 26 accommodating the size of the user's thigh. The hook 62 may be rotated so that it is generally parallel to the user's leg, or it may be removed if desired. A writing pad may be attached to the writing plate using the clip 60. The writing plate 40 may be pivoted to any convenient angle, so that the user may write on the pad while seated. The kneeboard 10 may be quickly removed by unfastening the Velcro® fasteners 36, 38, and stored by hanging the hook 62 on the vehicle steering wheel.

Figure 5:
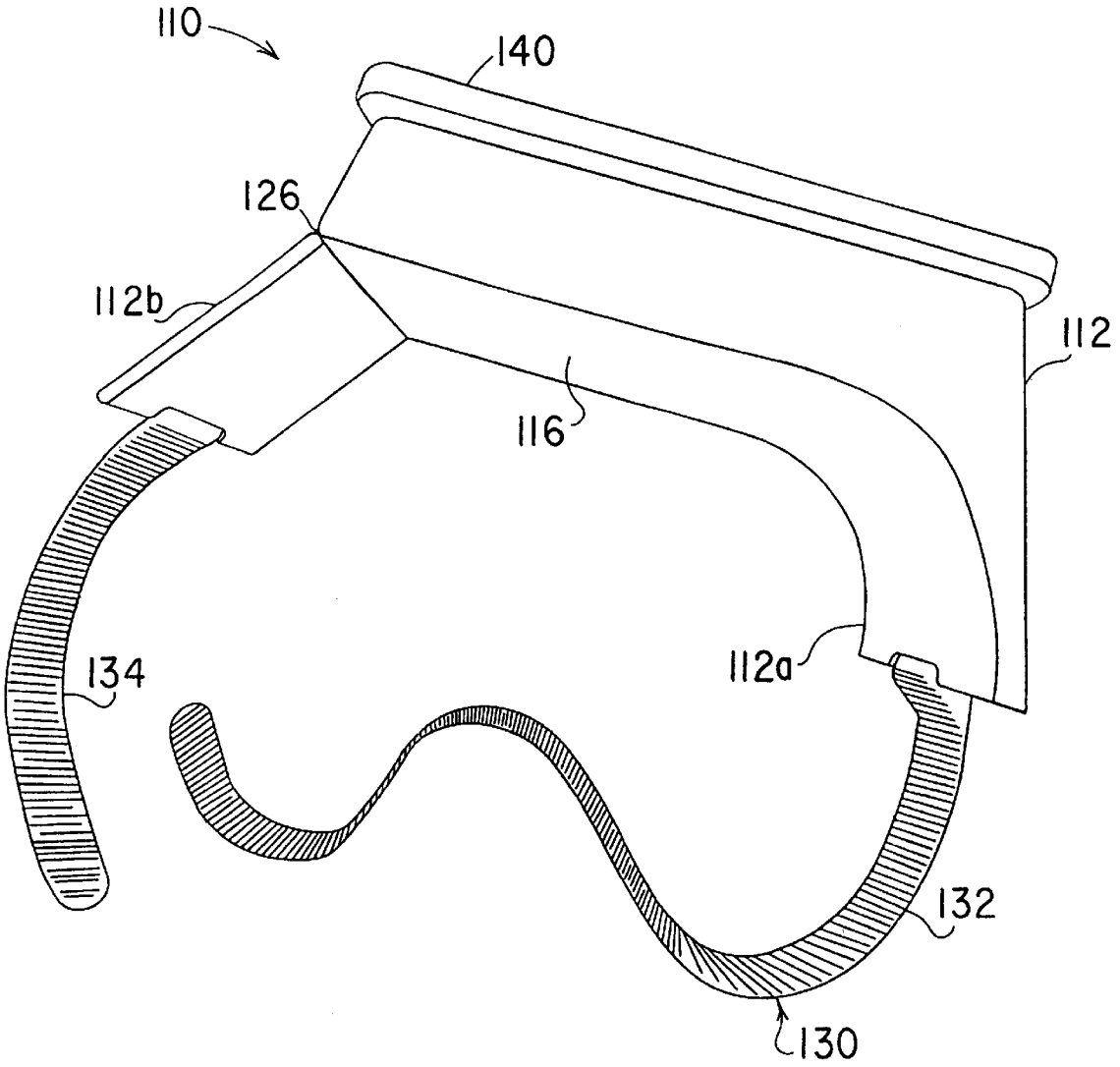
FIG. 5 is a rear, perspective view of an alternative embodiment of a swiveling automotive kneeboard according to the present invention.
Figure 6:
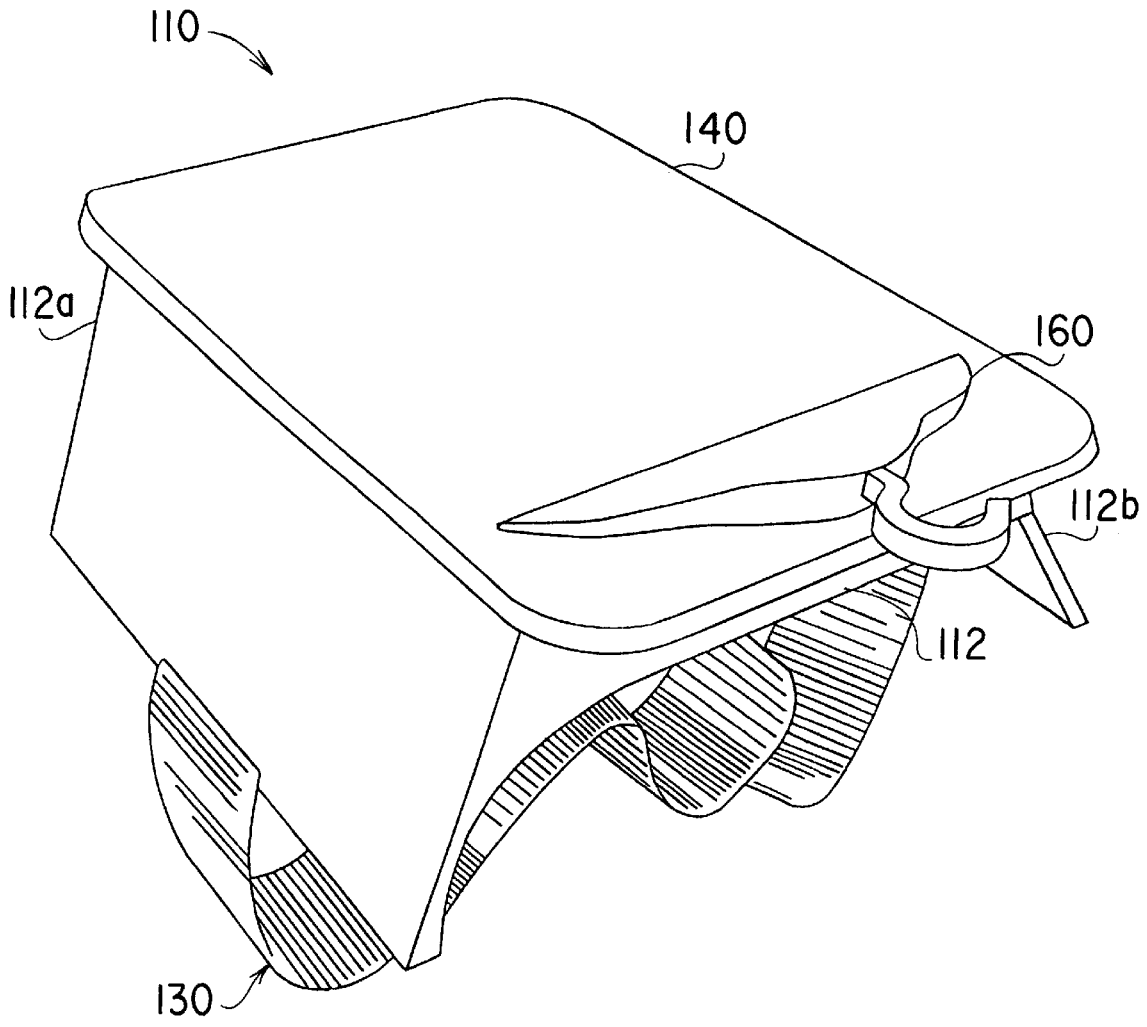
FIG. 6 is a side, perspective view of the embodiment of the invention shown in FIG. 5.

FIGS. 5 and 6 illustrate an alternative embodiment of the swiveling automotive kneeboard, designated generally as 110. As in the embodiment shown in FIGS. 1 through 4, the kneeboard 110 includes a base 112, a strap 130 for attaching the kneeboard to the user's thigh, a writing plate 140, and a conventional spring biased clip 160 for attaching a writing tablet or memo pad to the writing plate 140. Construction of the strap 130, writing plate 140, and clip 160 is substantially the same as the embodiment described above, and will not be further described, except to note that while the writing plate 140 is generally rectangular, its corners are rounded, an obvious modification of the writing plate 40.

The embodiment shown in FIGS. 5 and 6 differs essentially in the shape of the base 112 and the location of the living hinge 26. Whereas the base 12 in the first embodiment is described as having a concave bottom surface 16, the base 112 shown in FIGS. 5 and 6 has a substantially flat bottom surface 116 and a pair of legs 112*a*, 112*b* depending from the base 112. One leg 112*a* is rigidly attached to the base 116 and may be formed integrally with the base 112 during molding, the joint between the leg 112*a* and the bottom surface 116 of the base 112 being concave and arched or contoured to conform to the shape of the user's thigh. The other leg 112*b* is joined to the bottom surface 116 by a living hinge 126 which permits the diameter of the kneeboard 110 to be adjusted to the size of the user's thigh, as set forth above. The bottom surface 116 is shown without ribs in FIGS. 5 and 6, although it will be understood that the bottom surface 116 may have a plurality of reinforcing ribs 18 as shown in FIG. 2 and described above. The first 132 and second 134 pieces of the strap 130 are attached to the base 112 at the free ends of the legs 112*a*, 112*b*. In all other respects, construction of the base 112 is substantially the same as construction of the base 12 and will not be described further. It will be noted that the base 112 is thick enough that the socket corresponding to socket 20 may be housed completely within the base 112 and so that it is not discernable on the bottom surface 16.

It is to be understood that the present invention is not limited to the embodiments described above, but encompasses any and all embodiments within the scope of the following claims. It will be obvious to those skilled in the art that the kneeboard 10 may optionally be equipped with a pen holder on the clip 60 or on the writing plate 40. It will further be evident that although the primary use envisioned for the present invention is by the operator or passenger of an automobile, the invention may also be useful for airplane pilots, or by any person while seated, whether in a mode of conveyance or otherwise.

We claim:

1. A swiveling automotive kneeboard comprising:

a) a base having a top surface and a bottom surface;

b) a writing plate having a top surface and a bottom surface, the writing plate being pivotally attached to said base;

c) a spring-biased clip attached to said writing plate for clamping a writing tablet to said writing plate;

d) a strap attached to said base, the strap having two ends with fastening means for releasably fastening the two ends together; and e) a hook attached to said clip.

2. The swiveling automotive kneeboard according to claim 1, wherein the bottom surface of said base is concave.

3. The swiveling automotive kneeboard according to claim 1, further comprising a plurality of ribs extending longitudinally and laterally disposed on the bottom surface of said base.

4. The swiveling automotive kneeboard according to claim 1, wherein said base further comprises a living hinge extending longitudinally across said base, whereby said base folds in order to adjust the width of said base.

5. The swiveling automotive kneeboard according to claim 1, further comprising a plurality of ribs extending longitudinally and laterally disposed on the bottom surface of said writing plate.

6. The swiveling automotive kneeboard according to claim 1, wherein said strap comprises:

a) a first piece having a first end attached to the bottom surface of said base and a second end having a fastener attached thereto; and b) a second piece having a first end attached to the bottom surface of said base and a second end having a fastener attached thereto for releasably fastening said second piece to said first piece, whereby said first piece, said second piece and said base form a continuous loop.

7. The swiveling automotive kneeboard according to claim 1, wherein said fastening means comprises hook and loop fastening material.

8. The swiveling automotive kneeboard according to claim 1, further comprising:

a) a cylindrical socket defined in said base, the socket having a circular opening defined in the top surface of said base, the diameter of the opening being smaller that the diameter of the socket in order to define a rim projecting into the socket; and b) a male connector depending from the bottom surface of said writing plate, the male connector snapping into said cylindrical socket, said male connector and cylindrical socket forming a swiveling mechanism, said writing plate rotating 360° about said swiveling mechanism in a plane parallel to said base.

9. The swiveling automotive kneeboard according to claim 8, wherein said male connector comprises a plurality of legs arranged in a circular pattern, the diameter of the circle being substantially equal to the diameter of the circular opening defined in the top surface of said base, each of said legs having a flange extending radially outward from the circle defined by the legs, the flange sloping radially inward to form a pointed tip end of the leg, the flanges being inserted in said socket and engaging said rim in order to lock said writing plate to said base.

10. The swiveling automotive kneeboard according to claim 1, wherein said hook is pivotally attached to said clip.

11. The swiveling automotive kneeboard according to claim 1, wherein:

a) said hook further comprises a stem and a mouth;

b) said clip further comprises a socket integral with said clip;

c) said hook further comprises a male connector integral with said hook, the male connector removably snapping into the socket integral with said clip; and d) said hook rotates 360° about an axis parallel to and concentric with the stem of said hook.

12. The swiveling automotive kneeboard according to claim 1, wherein said hook is adapted for storing said kneeboard by hanging said hook on an automotive steering wheel.

13. The swiveling automotive kneeboard according to claim 1, wherein said base, said writing plate, said clip, and said hook are made from a lightweight, injection molded thermoplastic material.

14. The swiveling automotive kneeboard according to claim 1, wherein at least a portion of said strap is made from an elastic fabric material.

15. The swiveling automotive kneeboard according to claim 1, wherein the bottom surface of said base is substantially flat.

16. The swiveling automotive kneeboard according to claim 15, further comprising:

a) a first leg depending from said base, the first leg being rigidly attached to the base by a joint which is concave; and b) a second leg depending from said base, the second leg being attached to said base by a living hinge whereby said base folds in order to adjust the width of said base.

* * * * *